US006233851B1

(12) United States Patent
Alexander et al.

(10) Patent No.: US 6,233,851 B1
(45) Date of Patent: May 22, 2001

(54) LIGHTWEIGHT, FIGHTING POSITION EXCAVATION SYSTEM

(75) Inventors: Alan A. Alexander, Minnetonka; Gary W. Erickson, Maple Plain; Paul F. Schmidt, Brooklyn Park, all of MN (US)

(73) Assignee: Alliant Techsystems Inc., Hopkins, MN (US)

( * ) Notice: Subject to any disclaimer, the term of this patent is extended or adjusted under 35 U.S.C. 154(b) by 872 days.

(21) Appl. No.: 08/799,258

(22) Filed: Feb. 13, 1997

Related U.S. Application Data

(63) Continuation of application No. 08/566,585, filed on Nov. 30, 1995, now abandoned, which is a continuation of application No. 08/240,335, filed on May 10, 1994, now abandoned.

(51) Int. Cl.[7] ..... E02F 1/00

(52) U.S. Cl. ..... 37/195; 37/905; 172/371; 175/20; 175/57

(58) Field of Search ..... 37/905, 195; 175/2, 175/4, 57, 3, 20; 89/1.34; 102/302; 172/371, 378

(56) References Cited

U.S. PATENT DOCUMENTS

| | | | | |
|---|---|---|---|---|
| H913 | * | 5/1991 | Hershkowitz | 102/307 |
| 3,198,719 | * | 8/1965 | Stewart | 172/378 |
| 3,216,320 | | 11/1965 | Thomas et al. . | |
| 3,404,919 | * | 10/1968 | Dixon | 175/2 |
| 3,847,227 | * | 11/1974 | Myers | 172/378 |
| 4,232,422 | * | 11/1980 | Fellmann | 172/378 X |
| 4,550,786 | * | 11/1985 | Rosenstock | 175/2 |
| 4,946,521 | * | 8/1990 | Walker et al. | 149/36 |
| 5,014,623 | * | 5/1991 | Walker et al. | 102/477 |
| 5,158,146 | * | 10/1992 | Fuller | 175/122 |
| 5,275,245 | | 1/1994 | Clements . | |

FOREIGN PATENT DOCUMENTS

| | | | | |
|---|---|---|---|---|
| 257748 | * | 3/1988 | (EP) | 102/302 |
| 1330414 | * | 12/1973 | (GB) | 175/2 |

* cited by examiner

*Primary Examiner*—Victor Batson
(74) *Attorney, Agent, or Firm*—Nikolai, Mersereau & Dietz, P.A.

(57) ABSTRACT

A method and compact portable system for excavating a two-soldier fighting position is disclosed in which the method includes using a material-retention type auger to bore a plurality of spaced hollow recesses to a desired depth, placing prepared explosive charges in each bored recess, detonating the explosive charges using a remotely operable detonation device to loosen the soil in the defined pattern, removing the loosened soil, and finalizing the interior walls of the structure. The system is compact and lightweight designed to be stored within a confined carrying pack volume and features a bucket-type, hollow auger system including handle extensions capable of being quickly assembled to bore clean holes in the earth, a plurality of explosive charges, the explosive charges being stored in canisters of a size to fit into the hollow auger bit and holes bored by the auger, means for connecting to and remotely detonating the binary charges in each of the canisters.

13 Claims, 2 Drawing Sheets

LIGHTWEIGHT, FIGHTING POSITION EXCAVATION SYSTEM

This is a continuation application Ser. No. 08/566,585, filed Nov. 30, 1995 abandoned, which is a continuation of application Ser. No. 08/240,335, filed May 10, 1994 abandoned.

BACKGROUND OF THE INVENTION

I. Field of the Invention

The present invention relates generally to the field of manual excavation and, more particularly, to a relatively inexpensive lightweight and portable system for expediting the excavating of a military fighting position or foxhole.

For many years, military people have been looking at ways to significantly reduce the time it takes a soldier to establish a two-man fighting position and thereby improve a soldier's combat effectiveness. The need for infantryman or others to "dig in" to secure a position or reduce exposure to enemy fire, of course, is longstanding. Most of the time spent and energy consumed in creating a two-man fighting position is expended in the "digging" or soil loosening operation. If this significant segment of the fighting position creation operation could be automated or mechanized so that the soldier would only need to throw the dirt out of the hole without having to spend time and energy digging and loosening the dirt, he would gain a decided advantage. To date, that effort has been generally unsuccessful primarily because there has been no approach that meets the necessary criteria and so there remains a need for a lightweight, simple apparatus that is portable and compatible with the soldier's combat load and which works quickly and is able to address a variety of soils under a variety of weather conditions.

SUMMARY OF THE INVENTION

By means of the present invention, many of the problems associated with increasing the efficiency of establishing a two-man fighting position have been solved by the provision of a method and system that includes the use of a hole boring device in combination with soil loosening explosive charges that makes it necessary for the soldier only to have to throw the dirt out of the hole without having to spend time and energy loosening the soil.

In the preferred embodiment, the boring device is an auger of a modified bucket type which retains the material in a hollow central portion thereby creating a clean bore. These devices are similar to those used, for example, by the forest industry for taking soil samples. The auger is preferably an optimized design for making a number of bore holes in a wide variety of soils.

An explosive material which is preferably a binary type explosive, i.e., one which involves a mixture of two distinct materials, each of which is itself non-explosive but which combine to form an explosive mixture, is provided to be placed in prepared bores created by the auger to thereafter loosen soil according to a predetermined pattern based on bore depth and spacing. The binary explosive material is contained in a multi-compartment or two-piece container to ensure that mixing does not occur until the soldier completes certain required steps. Other types of explosive charges, of course, may be used.

An initiation system for safely fusing and detonating the explosive is also provided which may be a conventional electrically operated system or a non-electric or NONEL detonation system. The electrical system uses a standard blasting cap in conjunction with a spaced activating or firing device of the type typically used in military applications. A non-electric version of the system includes a Shock Tube Initiator (STI) used in combination with a non-electric detonator or (NONEL) which includes a length of shock tube and a remote blasting cap. The blasting cap is equipped with a small amount of igniter to initiate the detonation sequence for the binary explosive and is attached by an E-Z detonator connector to the binary explosive container by means of the shock tube connected to a primer cord (Primaline) having a small transition charge in a manner such that no primary explosives are buried in the ground.

The entire system is designed for compact assembly into a relatively small, lightweight carrying pack that can be carried by an individual soldier and is further designed to be compatible with the soldier's normal combat load. Total weight of the system may be less than 9 pounds (slightly more if additional explosive materials are carried for excavating additional fighting positions). The system is further designed to be transported and stored in hot, normal and cold temperatures and can be dropped to the user unit by fixed or rotary wing aircraft or other delivery method. There is no need for special tools or maintenance beyond routine inspection.

The method of use includes boring a plurality of spaced holes, normally two, in the ground to the desired depth, normally about 3½ feet (42 inches). The auger handle may be designed of a combined convenient length such that the desired depth can properly be gauged. Likewise, hole separation distance may be conveniently based on the length of the auger so that the soldier can lay the auger down from the first bore to identify the location for the second. Of course, the bore depth and separation distance need only to be an approximation based on the auger length to achieve the required result. This eliminates burdening the soldier with time-consuming tasks such as staking out and measuring base and depth and allows for ease of operation both daytime and nighttime conditions with or without cold weather gear.

If a binary explosive is used, the next step is to mix the binary explosive that is stored in separate parts in a self-contained explosive container. This is accomplished by combining the contents of the separate storage containers. The mixed binary explosive canister or container is then connected to the appropriate electrical or non-electrical detonation or initiation system. The soldier, from a safe distance, normally over 20 meters, can electronically fire or connect the shock tube which can be used to initiate the explosive from a safe distance using a conventional firing pin/blasting cap.

Detonating the explosive is designed to loosen the soil to a size and consistency easily shoveled and create a pocket of loose soil that is slightly less than the dimensions required for the fighting position. After the detonation of the explosive, the soldier can quickly and easily remove the bulk of loosened soil with a conventional digging spade.

The soldier then shapes the final foxhole ensuring that the side walls remain structurally sound. A grenade sump can then be formed using the auger. It has been found that the time required to prepare the fighting position is less than one-half of that conventionally needed, using entirely un-aided manual means.

BRIEF DESCRIPTION OF THE DRAWINGS

In the drawings, wherein like numerals are utilized to designate like parts throughout the same.

DETAILED DESCRIPTION

The present invention combines the rapid boring ability of a material-retaining hand auger and soil loosening explosive charges to greatly reduce the time and exertion required to create a two-man fighting position. The required tools and materials can be stowed and readily carried in a lightweight carrying pack by an infantryman. Such a pack is shown generally at 10 in FIG. 1, including weight centered suspending or carrying straps 12. An internal cutaway also shows the initial or digging section of the auger at 14 carrying and protecting a pair of nested binary explosive charges 16, an auger handle 18 together with intermediate extensions 20.

Figure 2A:
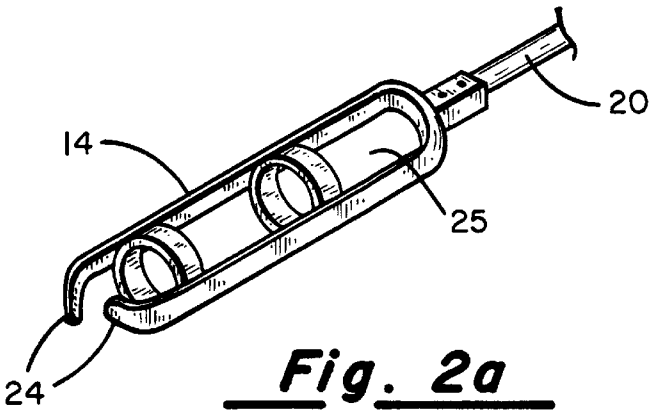
FIG. 2*a* is a partial view of an auger and part of the auger handle in accordance with the invention.

FIG. 2*a* depicts a preferred form of auger in which the initial, digging or bit section 14 is in the form of an open bucket which retains the material for lifting from the bore and dumping as the bit with boring bit members as at 24 rotates and bores through the soil. The auger bucket is normally made of stainless steel and provided with a quick-connect feature for easy assembly of the handle and extensions. Such a device presents a definite advantage over a screw type auger which, while a successful boring tool, is less successful when it comes to automatically removing the loose soil from the bored hole. Bucket-type augers of the material retention type are preferred and augers of this type have been used to obtain core samples of soil conducting soil surveys as far down as 40 feet in other applications. The bucket auger is designed to enable a soldier to dig a hole that is 36 to 42 inches deep within 3 to 5 minutes in a variety of soil types.

The normal commercial auger of the class is somewhat modified by changing threaded joints to the quick-connect/disconnect joints and modifying it to a square opening crossectional shape such that the user can assemble the auger at night quickly and easily even while wearing cold or foul weather gear. The auger is preferably made of stainless steel. While a variety of bit and auger bucket configurations and sizes could be used in different types of soils and the like, it is preferable to compromise with respect to the design so that the system is optimized for the widest variety of soils. Such a selection process was based on tests conducted in many different locations throughout the U.S., including discussions with soil conservationists who have used such augers for many years, and the companies that produce them. The rather large openings or windows as at 25 further represent a modification to reduce tool weight and optimize ease of cleaning soil from the bucket and further to allow packing of the explosive containers inside the bucket auger for compact storage and transportation.

It is contemplated that the extensions also be made from stainless steel and, like the auger, be of a length that is short enough, e.g., 16 inches, to keep the overall length of the carrying pack to less than 20 inches. Realizing an auger length of approximately 17 inches together with two extensions of 16 inches and adjusting the length for interlocking overlap, such a system has an approximate total working length of about 43 inches, which is sufficient to readily bore a hole 42 inches in depth. The handle is also preferably made from stainless steel and of a length that readily fits within the carrying pack. Such a handle is of sufficient strength and imports sufficient torque when hand operated to readily operate the auger system in all but the hardest of soils.

Figure 2C:
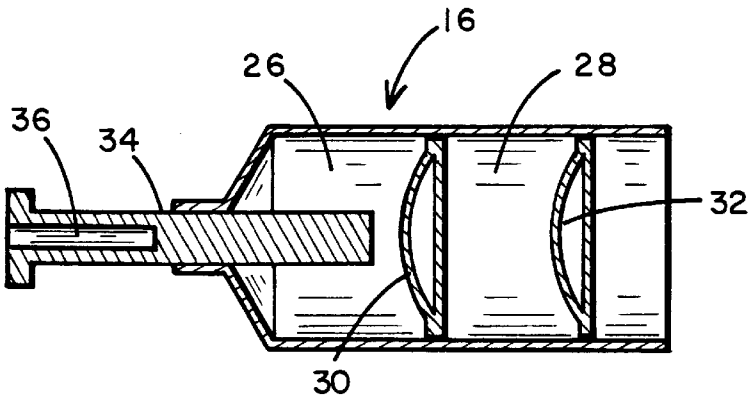
FIG. 2*c* depicts an embodiment of the soil loosening charge as stored prior to mixing.

FIG. 2*c* depicts one embodiment container 16 (FIG. 1) containing the two parts of the binary explosive with the materials making up the binary explosive mixture contained in separate compartments 26 and 28. Typically, the material in section 26 may be aluminum powder and that in 28 a type of low viscosity liquid oxidizer. Section 26 is further provided with a separation barrier 30 and the section 28 with an end seal as at 32. A plunger mechanism 34 is provided to be operated by a charge contained in a charge well 36.

Figure 1:
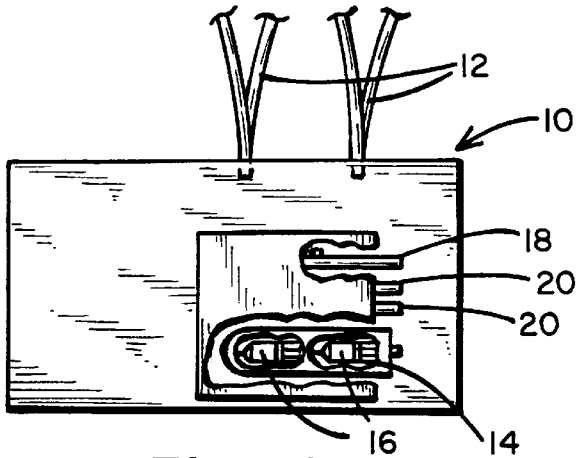
FIG. 1 is a schematic illustration of the system of the invention assembled in a carrying pack.

Whereas many different explosive materials may be employed in accordance with the invention, the use of a binary system mixed on site is preferred. The binary explosive itself may be one such as Binex XP-40 developed by and available from Binex, Inc. of Murray, Utah. As indicated, the formulation consists of two components which are non-explosive when separated and become a detonatable explosive only when mixed. This design provides the soldier with an explosive that is completely safe during storage and transportation. In a preferred embodiment, the two components are an aluminum powder (42%) mixed with an agent to increase usable shelf life and a low viscosity liquid oxidizer (58%). A liquid oxidizer designed to survive storage cold temperatures is needed. For added safety, the binary explosive containers are shown housed in the bucket auger (FIG. 1).

In accordance with the design, the container is constructed to prevent inadvertent mixing, thus ensuring the continued safety of the device under any circumstances during storage and transportation. The combined container explosive content is about 150–250 grams of binary explosive. Utilizing two containers of approximately this weight has been found to achieve the most efficient design for the widest variety of soils. A booster may be made to initiate the reaction of the binary explosive if desired.

Figure 2B:
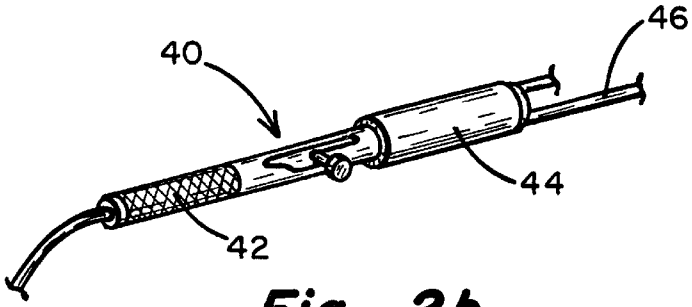
FIG. 2*b* depicts a firing device for use in the invention.

A detonation device is shown in FIG. 2*b* generally at 40. This is a shock tube-type firing device and includes an initiator 42 which is a surface signal projector such as an MK31 Mod 0 surface signal projector, and a shock tube initiator (STI) such as an Ensign-Bickford Shock Tube Initiator which can be used with a number of firing devices. This system is used to initiate a length of shock tube 46, which may be a MK120 shock tube, which, in turn, is connected to a nonel cap 48 (FIG. 3*b*). This initiating system for detonation has been type classified by DOD for military use, such being further indicative of safety and reliability. The shock tube initiation system operates in conjunction with a nonel cap 48 which connects to a pair of mild detonating fuses 50, 52, which are inserted into the plunger charge well 36 of the explosive device 16 just prior to connection. The shock tube transmits the detonation signal from the signal projector at a safe distance. Detonation is sustained by such a small quantity of reactive material in this embodiment that the outer surface of the shock tube remains intact during and even after functioning. The firing device can be actuated at a distance beyond the safety zone (approximately 20 meters).

It will further be appreciated that the explosive charge can be configured to be detonated utilizing an electric detonator system such as those utilized in Claymore mines, or the like, using a blasting cap.

Figure 3A:
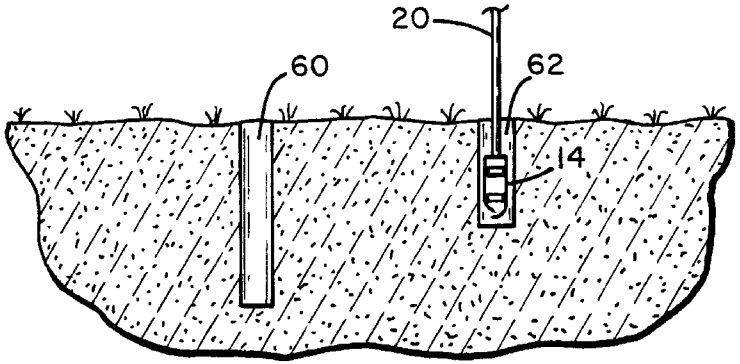
FIGS. 3*a*–3*d* illustrate steps in the method of the invention.
Figure 3B:
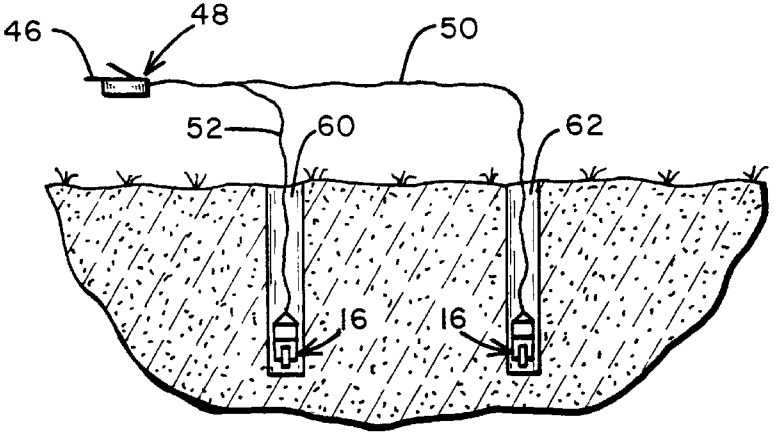

The method of rapid excavation of the invention is illustrated in FIGS. 3*a*–3*d*. FIG. 3*a* is a fragmentary sectional elevational view through a pair of spaced bore holes excavated in accordance with the invention in which a first bore hole 60 is shown completed and a second bore hole 62 in the process of being dug by a bucket auger 14. Thus, the two holes are normally bored into the ground with an auger to a depth of approximately 3½ feet (1.07 m) using the auger handle as a gauge. The same auger handle can be used to space the holes, generally 3–3½ feet (1.07 m) apart. This enables the soldier to provide holes of the correct spacing and depth without making additional measurements. This step takes anywhere from 3 to 5 minutes, depending on soil type and condition. Of course, the dimensions need only be approximate to produce satisfactory results inasmuch as the position size is somewhat arbitrary.

Figure 3C:
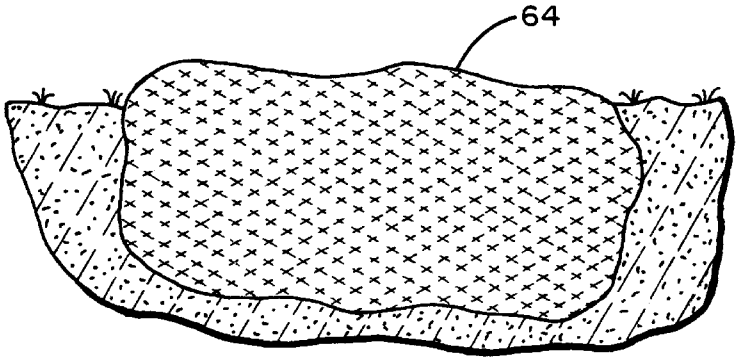

The next step is to prepare the binary explosive from the separately stored components, the precise method of combination being dependent upon the design of the composite container or can involved. In this step, the aluminum powder or other material is mixed with the liquid oxidizing solution to form the binary explosive. The required charge is about 150–250 grams per bore hole. In accordance with the electrical detonating system, the blasting cap is inserted in the blasting cap well of the binary explosive container and both leads are connected to a remote electrical-type firing device such as that shown in FIG. 2*b*. FIG. 3*c* shows the loosened soil immediately after detonation of the pair of binary explosive charges 16 in FIG. 3*b*. The dimensions of the loosened area at 64 should be somewhat smaller than those desired for the final fighting position so that the final walls can be shaped and stabilized by hand.

Figure 3D:
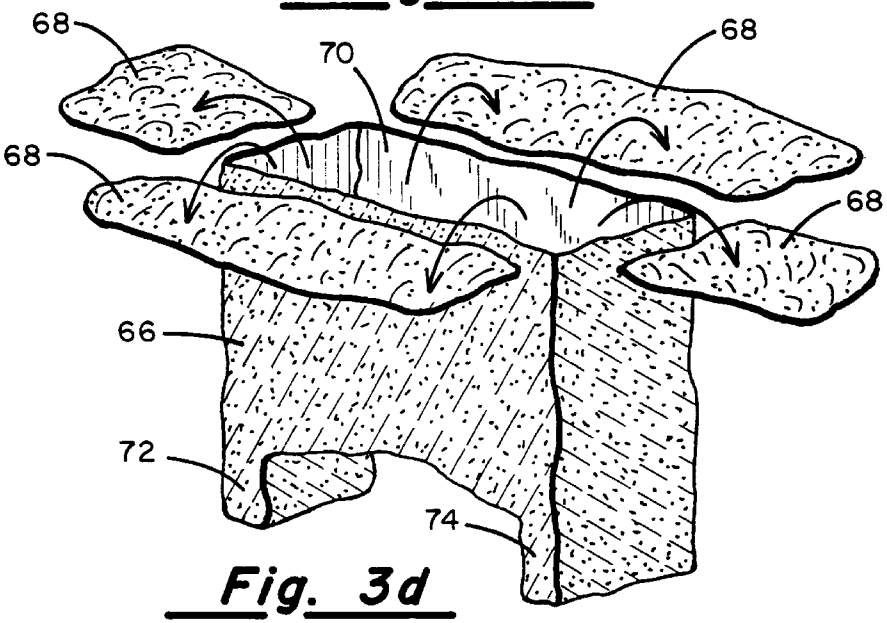

The perspective view of FIG. 3*d* depicts the dug-out hollow form of the fighting position as at 66 in which the loosened soil has been shoveled out to areas 68 surrounding the top opening 70, the walls having further been vertically established and grenade sumps 72 and 74 hollowed out on the ends of the finalized fighting position. This final step in preparing the position takes little time as the great majority and bulk of the soil is quite loose and very easily removed and thrown out of the enlarging hole by the soldier.

The excavation system and method of the invention enables the preparation of a two-soldier fighting position in less than half the normal time with a great deal less heavy work. This not only enables the position to be prepared much faster but leaves the users in a far less exhausted condition. It will further be appreciated that whereas the system has been described with respect to the use of optimized auger and charges, for example, shaped charges, a specialized auger or other modifications could enable the use of the system in permafrost, very rocky soils or the like.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

We claim:

1. A compact, lightweight kit for the preparation of a two-man fighting position comprising in combination:

(a) a bucket-type, material retention auger system including a hollow material-retention bit and a plurality of handle extensions capable of being quickly assembled to bore holes in the earth;

(b) a plurality of explosive charges stored in containers that fit into holes bored by the auger system wherein the explosive charge containers nest within the hollow material-retention auger bit for storage and transportation;

(c) detonation means for connecting to each of said containers and remotely detonating the charges in each of said containers under control of a user; and (d) a lightweight carrying pack for containing elements (a)–(c) in compact form.

2. The kit of claim 1 wherein the means for detonating the charges is a non-electric system.

3. The kit of claim 1 wherein the explosive charges comprise a binary explosive mixture.

4. The kit of claim 3 wherein the binary explosive is a mixture of aluminum powder and a liquid oxidizer.

5. The kit of claim 1 including additional explosive charges for preparing additional positions.

6. A compact, lightweight kit for the preparation of a two-man fighting position comprising in combination:

(a) a bucket-type, material retention auger system including a hollow material-retention bit and a plurality of handle extensions capable of being quickly assembled to bore holes in the earth;

(b) a plurality of explosive charges stored in containers that fit into holes bored by the auger system wherein the explosive charge containers nest within the hollow material-retention auger bit for storage and transportation;

(c) wherein the explosive charges are binary explosive charges having two separately stored materials capable of being mixed in the containers;

(d) detonation means for connecting to each of said containers and remotely detonating the charges in each of said containers under control of a user; and (e) a lightweight carrying pack for containing said auger, explosive charges stored in containers, and detonation means in compact form.

7. The kit of claim 6 wherein the binary explosive is a mixture of aluminum powder and a liquid oxidizer.

8. A method of using a lightweight kit for excavating a two-soldier fighting position comprising the steps of:

(a) assembling a bucket-type material-retention auger system including a hollow material-retention bit and a plurality of handle extensions and using said auger to bore a plurality of spaced hollow recesses to a desired depth;

(b) preparing detonatable explosive charges from individually non-explosive constituents contained in charge containers which nest within the hollow material-retention auger bit for storage and transportation and placing the prepared detonatable explosive charges in said containers as prepared explosive charges;

(c) placing prepared explosive charges in the bottom of each of said bored recesses, said charges being connected to a remotely operatable detonation device;

(d) detonating the explosive charges thereby loosening the soil in a defined pattern;

(e) removing the loosened soil; and (f) adjusting the interior walls of the structure as needed.

9. The method of claim 8 wherein the preparation of the detonatable explosive charges from individually non-explosive constituents further comprises mixing two ingredients to produce a binary explosive mixture.

10. The method of claim 9 wherein the binary explosive is a mixture of aluminum powder and a liquid oxidizer.

11. The method of claim 1 wherein the number of recesses is two.

12. The method of claim 11 wherein a final fighting position size is approximately 6' long by 2' wide by 4' deep.

13. The method of claim 1 wherein the spaced bored holes are approximately 3½ feet apart and 3½ feet deep.

* * * * *